US005721564A

United States Patent [19]

Patel

[11] Patent Number: 5,721,564

[45] Date of Patent: Feb. 24, 1998

[54] ELECTROMAGNETICALLY OPERATED LINEARLY SLIDING SHUTTER FOR A VARIABLE DISPLAY

[75] Inventor: Milan Patel, Concord, Canada

[73] Assignee: Ledstar Inc., Downsview, Canada

[21] Appl. No.: 573,769

[22] Filed: Dec. 18, 1995

[51] Int. Cl.[6] ..... E09F 09/30

[52] U.S. Cl. ..... 345/109; 345/32; 345/33; 345/84; 345/108; 345/111

[58] Field of Search ..... 345/32, 33, 84, 345/108, 109, 111; 340/815.42, 815.43, 815.45, 815.62, 815.64, 815.68

[56] References Cited

U.S. PATENT DOCUMENTS

| | | | |
|---|---|---|---|
| 4,163,332 | 8/1979 | Salam | 40/449 |
| 4,794,391 | 12/1988 | Costa et al. | 340/815.31 |
| 4,819,357 | 4/1989 | Salam | 40/449 |
| 5,160,921 | 11/1992 | Killinger | 340/783 |
| 5,337,077 | 8/1994 | Browne | 345/109 |
| 5,351,065 | 9/1994 | Killinger | 345/109 |

FOREIGN PATENT DOCUMENTS

| | | | |
|---|---|---|---|
| 2580109 | 4/1986 | France | 345/84 |
| 2664728 | 11/1990 | France | 345/111 |

*Primary Examiner*—Raymond J. Bayerl
*Assistant Examiner*—Vincent E. Kovalick
*Attorney, Agent, or Firm*—Jane Parsons

[57] ABSTRACT

An electromagnetically operated, linearly sliding shutter is provided for a light source emanating from a fiber optic light guide, used for example, in a variable display such as those providing information to motorists on highways. For such a display a plurality of shutters in an array is provided with individual shutters being operable under computer control to occlude or allow passage of light in a predetermined pattern. The shutter may include a base unit having bores to hold the end of the fiber optic guide and control electromagnetic coils, and a shutter unit having a slide movable into and out of the path of light from the guide. The shutter unit may be sealed against entry of dust and dirt.

6 Claims, 6 Drawing Sheets

ELECTROMAGNETICALLY OPERATED LINEARLY SLIDING SHUTTER FOR A VARIABLE DISPLAY

BACKGROUND OF THE INVENTION

1. Field of the Invention

This invention relates to an electromagnetically operable linearly sliding shutter for light from a fiber optic guide. The shutter may be one of an array of shutters selectively operable for variable composite display to a viewer, such as a display for information for motorists which may be located above a highway.

2. Acknowledgement of the Prior Art

Previously known information displays on highways may be lit by a matrix of light sources which, themselves, may originate from light emitting diodes or from fiber optic sources. For these devices it is necessary to provide shutters which open and close precisely and reliably under all conditions such as extreme cold, extreme heat, dust, dirt and other environmental difficulties. In the past, these shutters have generally been rotatable shutters such as those described in U.S. Pat. No. 4,794,391 issued Dec. 27, 1988 to Costa et al. and U.S. Pat. No. 5,337,077 issued Aug. 9, 1994 to Browne. Both these patents describe variable displays having an array of rotatable shutters which rotate about a pivot.

Considerable engineering precision is required for the reliable operation of this type of rotatable shutter. Moreover, such shutters may be inherently difficult to protect from clogging by dust and other environmental difficulties. The pivot points are very susceptible to clogging, thus rendering the device sticky or inoperable.

The present inventor has addressed the problems associated with the use of rotatable shutters in arrays of point light sources in variable displays.

SUMMARY OF THE INVENTION

A fiber optic light guide is used to project a light beam of a defined convergence to the viewer. The visibility of the light beam to the viewer is controlled by an electromagnetic shutter that is between the exit point of the fiber optic light guide and the viewer. Such fiber optic light guides are arranged in an array to form a dot matrix. By allowing the electromagnetic shutter, under computer control, to selectively and dynamically occlude the passage of light to the viewer a light emitting display that is capable of dynamically displaying alphanumeric and graphic images is formed.

The present invention comprises a slide unit having electromagnetically operable linearly sliding slide, which may either occlude or allow the passage of light under the influence of an appropriate magnetic field. Such a field may be generated by a magnetic core that is placed in proximity to the shutter. The slide unit is used with a base which forms the interface between the slide unit and fiber optic light guides. The base contains a pair of cores whose magnetic field polarity can be controlled by an electric current. Any number of such slide assemblies are configured on a panel in matrix form to create a display.

Thus according to the invention there is provided an electromagnetically operated, linearly sliding, shutter capable, on the one hand, of occluding the passage of light towards a viewer, the light emanating from a fiber optic light guide and, on the other hand, of allowing the transmission of said light towards the viewer; the shutter comprising:

a base having an access bore thereinto for the entry of a source end of a fiber optic light guide and having at least one other bore in which is located a core of magnetic material having a wire coil wound therearound;

means to impart electric current selectively to each of the coils to impart a magnetic field to the cores;

a slide assembly located in the path of light from the fiber optic light guide, the slide assembly comprising a housing having windows aligned in said path for the passage of light therethrough, and a slide linearly slidable within said housing between a first position in which it occludes the passage of light along said path between the windows and a second position in which it allows said passage of light, the slide including a permanent magnet, magnetic poles of which are oriented such that it is attracted or repelled to move in one direction or an opposite direction in dependence upon said magnetic field;

whereby, when said slide is in said one position light is occluded from passing through the windows and no light shows to the viewer and when said slider is in its second position light passes through the windows to be seen by the viewer.

The shutters of the invention may be arranged in an array to create a light emitting display for the presentation of dynamic alphanumeric and graphic images to viewers. Individual shutter of the display may be operated under computer control so that selected ones of the shutter allow the passage of light in a predetermined pattern. A multiplicity of the shutters of the invention may be arranged in clusters and a multiplicity of these clusters may be arranged in matrix form with each shutter of the cluster emitting light of a different colour to create a multi-color display.

BRIEF DESCRIPTION OF THE DRAWINGS

An embodiment of the invention will now be described by way of example with reference to the drawings, in which.

DETAILED DESCRIPTION OF A PREFERRED EMBODIMENT

Figure 1:
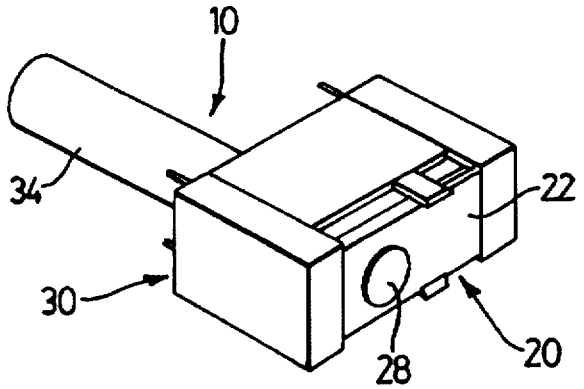
FIG. 1 depicts a shutter assembly according to the invention, in a front isometric view;.
Figure 2:
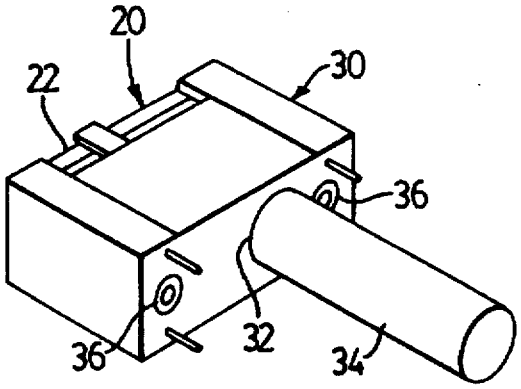
FIG. 2 depicts the shutter assembly of FIG. 1, in a rear isometric view.
Figure 3:
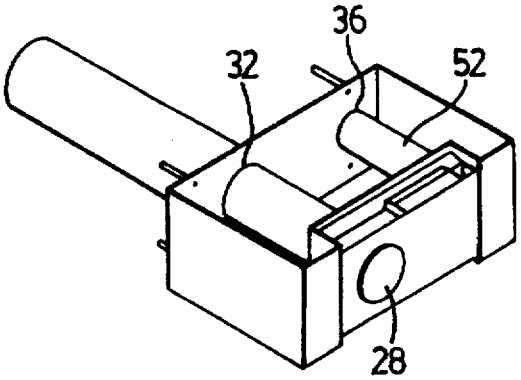
FIG. 3 depicts the shutter of FIG. 1 partially cut away from the top.
Figure 4:
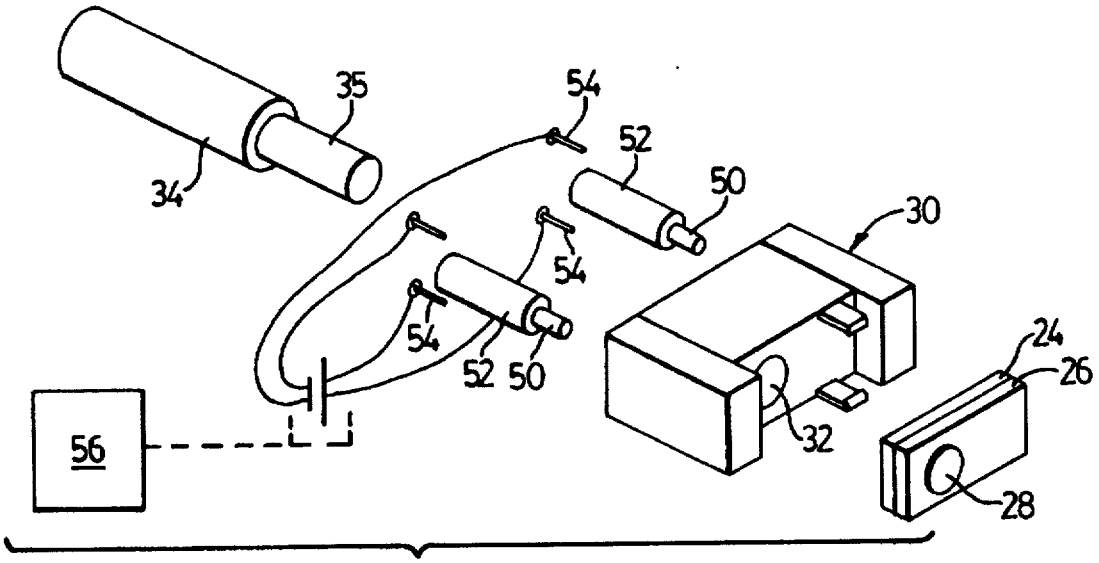
FIG. 4 depicts the shutter of the previous figure in a front perspective exploded view.
Figure 5:
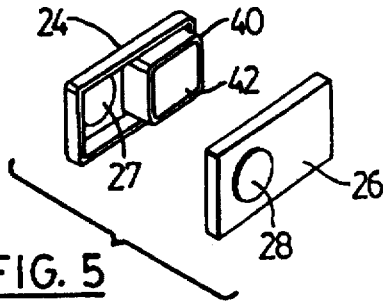
FIG. 5 depicts the slide assembly of the shutter of the previous figures in a perspective exploded view.
Figure 6:
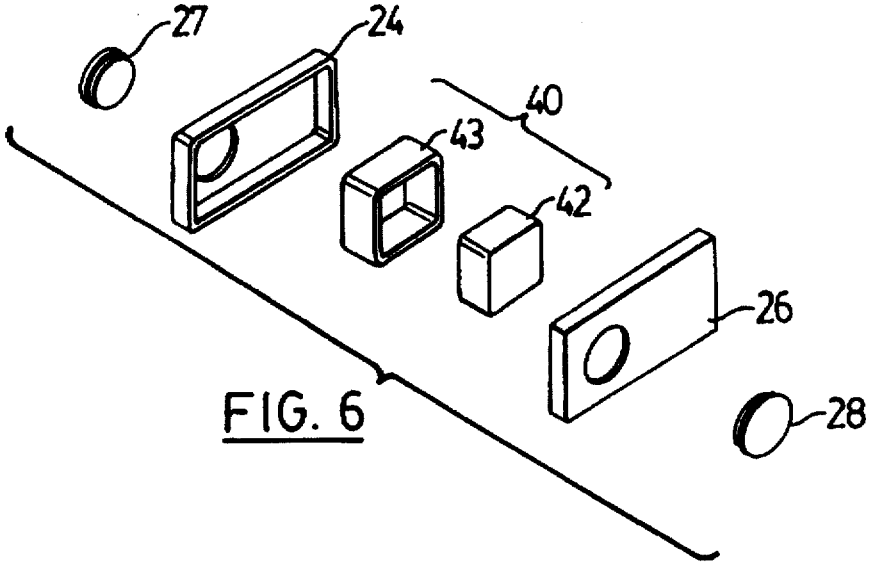
FIG. 6 depicts the slide assembly of FIG. 5 in a further exploded perspective view.
Figure 7:
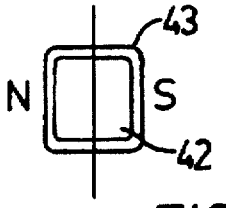
FIG. 7 depicts the slide in a front view.

A shutter 10 comprises a slide assembly 20 and a base 30. The base 30 has an access bore 32 for a fiber optic light guide 34 to locate the fiber optic light guide such that light emitted from its light emitting end 35 falls on the slide assembly 20.

The slide assembly 20 comprises a housing 22 formed by a rear wall portion 24 and a front wall portion 26. Windows 27 and 28 are located in the rear wall portion 24 and the front wall portion 26 respectively. The windows 27 and 28 are aligned with each other in the path of a light beam from the light emitting end of the fiber optic light guide 34. The windows 27 and 28 are conveniently lenses. However the front or rear wall portion 24, 26 may be formed from transparent material so that the front and rear walls themselves form the windows. Alternatively the windows may be open apertures into the housing 22, although it is preferred that the housing 22 be sealed from the environment.

A linearly movable rectangular, opaque, slide 40 is movable within the housing 22 from one position in which it occludes light from passage through windows 27 and 28 and a second position in which it allows passage of light through windows 27 and 28.

The slide 40 includes a permanent magnet 42 which does not detract from its opacity. The magnet 42 may be set in frame 43. The magnet 42 has its north and south poles oriented along a lateral axis and is sized so that it is smaller in thickness than the slide 40, this allowing the slide 40 to freely traverse linearly within the assembly housing 22. The magnet 42 never makes contact with the rear wall portion 24 and the front wall portion 26 of the housing 22 and thus potential friction on the magnet is minimized.

The housing 22 and slide 40 are molded from a high lubricity plastic allowing free and unrestricted movement of the slider. The nature of such high lubricity plastics minimizes friction and allows very low wear on the parts. In the embodiment shown the windows 27, 28 are lenses set into the rear and front wall portion 24 and 26 respectively. The window lenses 27 and 28 are molded from a high clarity plastic to allow light passage with minimal attenuation. Each window lens is bonded to a respective front or rear wall portion, and the two portions are bonded to each other to create a cavity that is environmentally sealed from external contaminants. The slide 40 resides within this cavity and may be immune to external environmental contaminants.

The base 30, which may also be molded from plastic material is provided with a pair of other bores 36 to hold electromagnetic coils 52 about cores 50 which, upon activation initiate movement of slide 40.

Each coil 52 is wound around a core 50 which, when energized with a short pulse of electric current, imparts a magnetic field to the cores. When each core is of a high remanence magnetic material it may be activated by a short pulse of electrical energy. The resulting magnetic field will be retained by the core and continue to exert an effect on the permanent magnet 42. If, however, magnetic material of low remanence is used it will be necessary to use sustained current in coils 52 to maintain the magnetic field.

It may be possible to utilize a single core, and a single coil in a single bore 36 it if is convenient to reverse the direction of current for each designed movement of slide 40.

A computer 56 can be used to control the coils 52 through circuitry interfacing with coils 52 through connection pins 54. The cores are preferably of a material having a high magnetic remanence so that they maintain their magnetic polarity and hence the position of the slide 40 even when there is no electric current in the coils 52. Thus there is no need to maintain current once the desired position of the slide has been achieved. Current is only necessary to cause the position to change.

The fiber optic light guide 34 may suitably be terminated in a divergent cone or lens 60 to project a beam of light to the viewer. Such a divergent cone or lens 60 may be installed in the access bore 32 of the base or it may be an integrally molded element of the fiber optic light guide. In either case, the divergent cone or lens 60 is designed to diverge the light emitting from the fiber optic light guide to allow a viewer to receive light at a given intensity from within a given viewing cone. A colored filter 58 may be also placed in front of the diverged cone or lens to modify the output color of the light. The slide assembly 20 fits tightly against the base 30 in a manner that prevents escape of light from its sides so that light is only allowed to pass through the window lenses 27 and 28.

Figure 8:
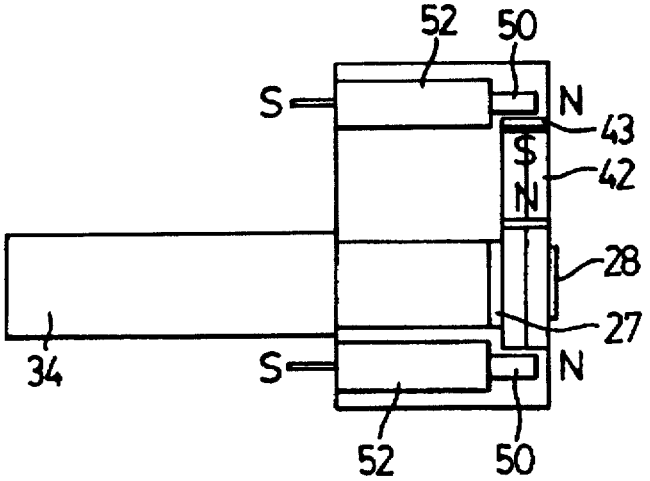
FIG. 8 depicts in cross section shutter of FIGS. 1–4 with the slide in a position that does not occlude the passage of light.
Figure 9:
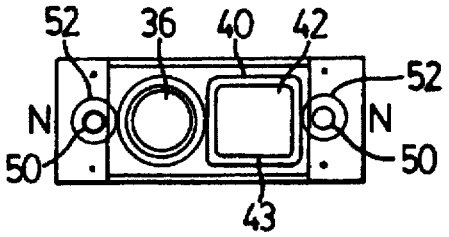
FIG. 9 shows a front view of the shutter of FIG. 8.

Operation of the device will now be described with reference to FIGS. 8–11. When the slide assembly 20 is installed in the base 30, the cores 50 are in close proximity to the magnet 42 in the slide 40. This proximity allow the magnetic field of the cores 50 to interact with the magnetic field of the magnet 42. The interaction is based on the fact that like magnetic poles physically repel each other while opposite poles physically attract each other. The slide 40 with the magnet 42 is free to traverse linearly within the slide housing 22. With the polarity of the cores as shown in FIGS. 8 and 9, the slide 40 will travel to a position that allows unobstructed passage of light from the fiber optic light guide 34 to the viewer. FIG. 9 shows the polarity of both cores 50 (at the slide assembly side) to be north, which causes the slide 40 to move to the non-occluding position whereby the south pole of the magnet is closest to the north pole of one core and the north pole of the magnet is furthest from the north pole of the opposite core 50.

Figure 10:
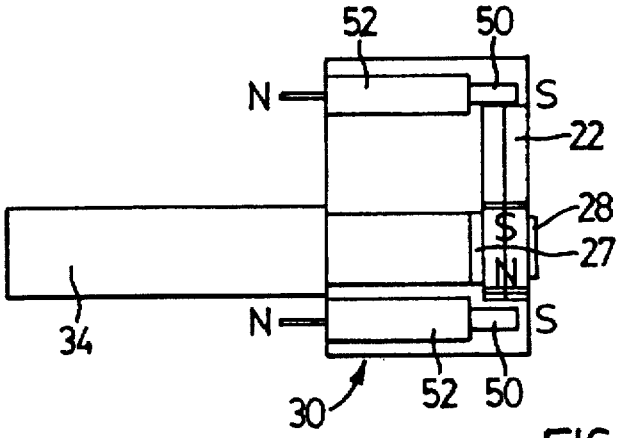
FIG. 10 depicts in cross section the shutter of FIGS. 1–4 with the slide in a position that occludes the passage of light.
Figure 11:
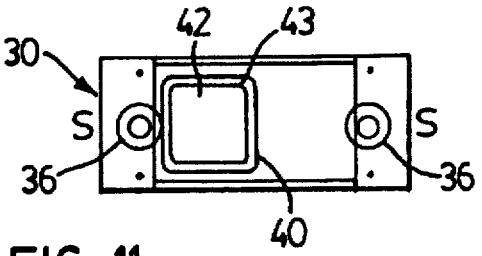
FIG. 11 depicts a front view of the shutter of FIG. 10.
Figure 12:
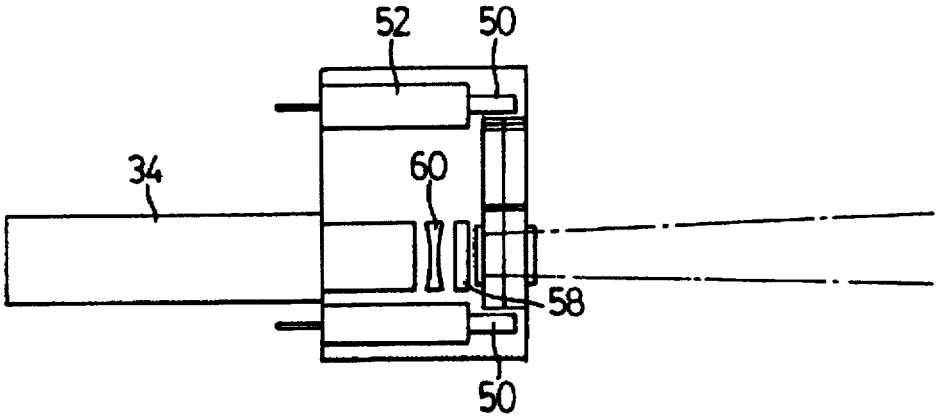
FIG. 12 depicts the use of a lens and color filter to modify the light beam from the fiber optic light guide.

FIGS. 10 and 11 depict the case where the passage of light from the fiber optic light guide 34 is fully obstructed by the slide 40. In this situation the slide 40 is positioned so that both cores 50 are polarized south (at the slide assembly side). This causes the slide 40 to move to a position that occludes the passage of light from the fiber optic light guide 34 to the viewer. The slide 40 moves so that the north pole of magnet 42 is closest to the south pole of one core 50, and the south pole of magnet 42 is furthest away from the south pole of the opposite core 50. The magnetic polarity of the cores 50 can be reversed by pulsing current of the appropriate polarity in the coils 52. Once the cores have their polarity set, the slide 40 will move to the appropriate position. The slide 40 is always in one of two bistable positions, either occluding light or allowing passage of light, but never in an intermediate position.

In the embodiment shown the slide assembly 20 may be easily disassembled by unclipping the slide unit 22 from the base 30. Other variations are also possible, for example the base 30 and slide unit 22 may be molded of a single piece for cost reduction. The cores 50 may be oriented in other ways so long as the ends of the cores 50 remain in proximity to the slide 40 to traverse to its other bistable position. The slide unit 22 may be made from an optically clear material thus avoiding the requirement of a separate lens provided that the slide 40 itself is opaque and fits closely within the unit 22 to prevent unwanted escape of light. The windows 27, 28 may be open to the atmosphere if an environmentally sealed unit is not desired. Other variations in geometry of the device are also possible, all resulting in a fundamental device that occludes light by means of a slide that moves in a linear manner between two bistable positions.

Figure 13:
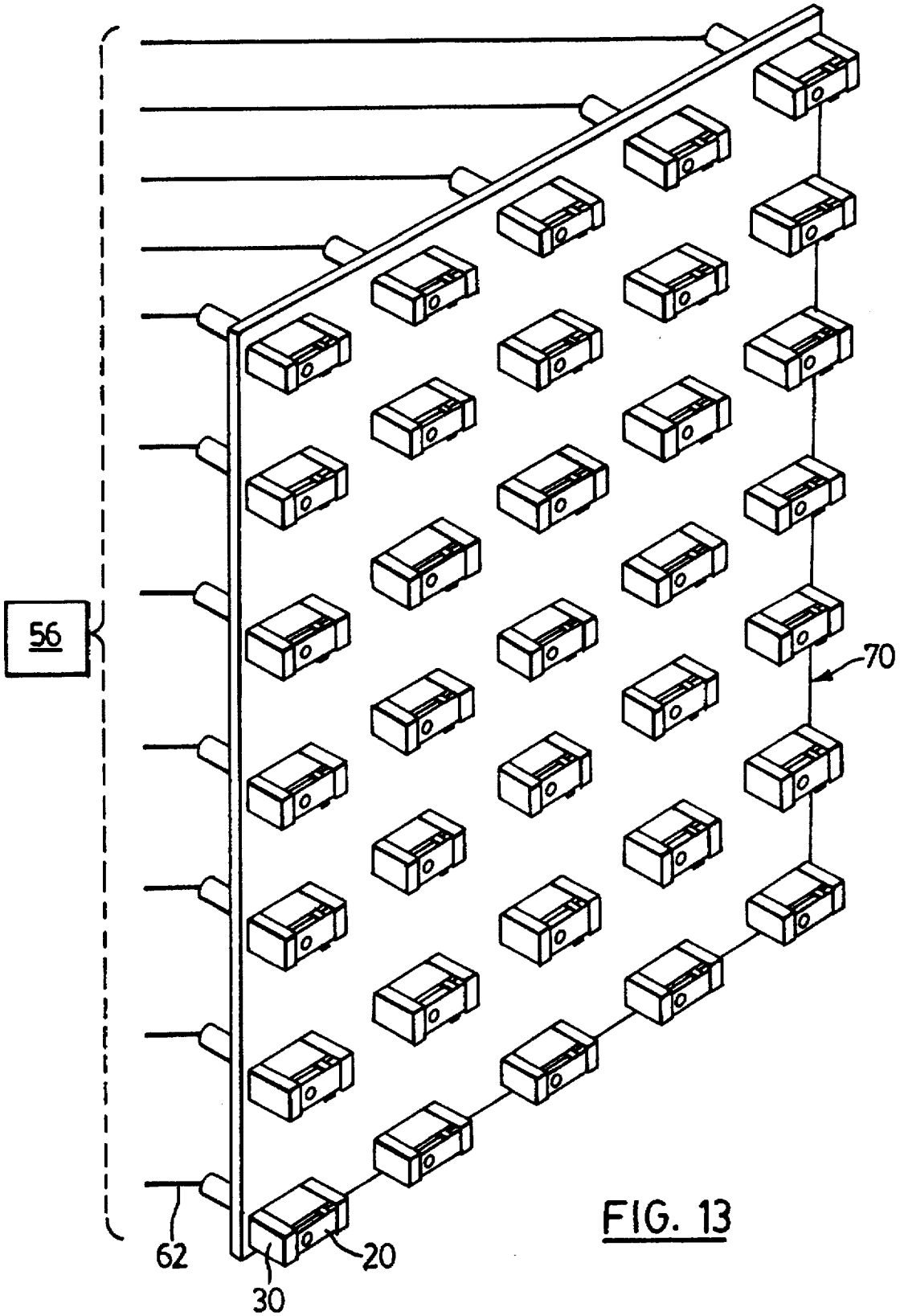
FIG. 13 depicts in perspective a possible configuration of the electromagnetic shutters in a module to form a display assembly.
Figure 14:
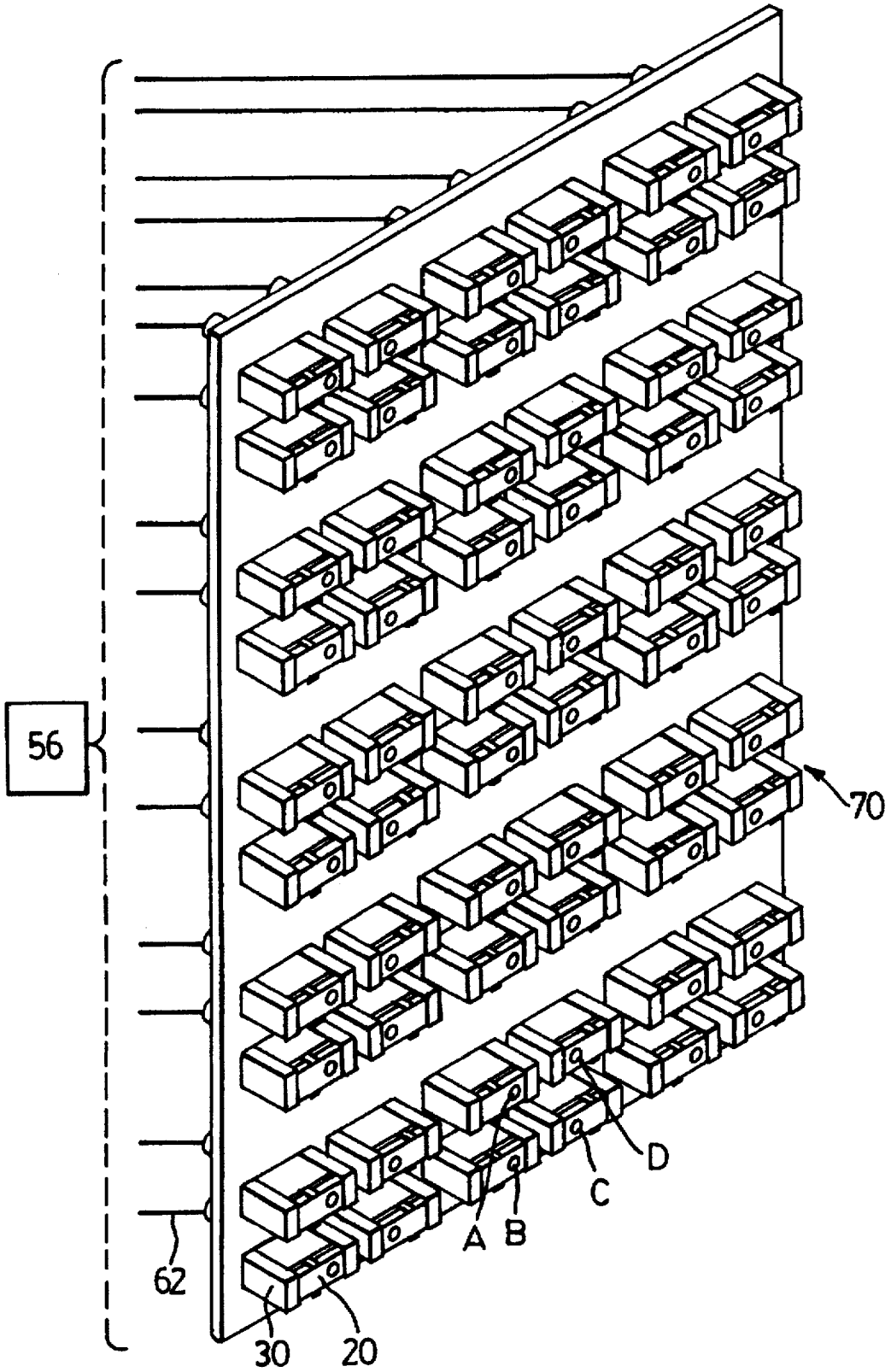
FIG. 14 depicts in perspective a multiplicity of electromagnetic shutters in a cluster arrangement to form a multicolor display.

An array 70 of electromagnetic shutters (FIG. 13) can be arranged to form a display. An appropriate computer 56 and interface circuitry 62 can be used to control the coils 52 of the slide assemblies 20. The resulting occluded or non-occluded passage of light from the various units presents a predetermined pattern of light to the viewer. With the use of color filters installed in the fiber light guides, displays with various colors can be constructed. In fact the slide assemblies 20 may be grouped together in clusters, such as shown in FIG. 14 where A, B, C, and D form a cluster, with each shutter in the cluster outputting a different color, and such clusters arrayed to form a display. Such an array would allow a display that is multicolored.

I claim:

1. An electromagnetically operated linearly sliding shutter capable, on the one hand, of occluding the passage of light towards a viewer, the light emanating from a fiber optic light guide and, on the other hand, of allowing the transmission of said light towards the viewer; the shutter comprising:

a base having an access bore thereinto for the entry of a source end of a fiber optic light guide and having a pair of other bores in each of which is located a core of high remanence magnetic material having a wire coil wound therearound;

means to impart a pulse of electric current selectively to each of the coils to impart a magnetic field to the respective core;

a slide assembly located in the path of light from the fiber optic light guide, the slide assembly comprising a housing having windows aligned in said path for the passage of light therethrough, and a slide linearly laterally slidable within said housing between a first position in which it occludes the passage of light along said path between the windows and a second position in which it allows said passage of light, the slide including a permanent magnet, magnetic poles of which are oriented such that the slide is attracted or repelled to move in one direction or an opposite direction according to which of the cores is magnetized;

whereby, when said slide is in said one position light is occluded from passing through the windows and no light shows to the viewer and when said slide is in its second position light passes through the windows to be seen by the viewer.

2. A shutter as claimed in claim 1 in which the unit is sealed from the environment.

3. A shutter as claimed in claim 1 including a color filter interposed in the path of light from said fiber optic light guide.

4. A variable display comprising an array of shutters, each shutter comprising:

a base having an access bore thereinto for the entry of a source end of a fiber optic light guide and having a pair of other bores in each of which is located a core of high remanence magnetic material having a wire coil wound therearound;

means to impart a pulse of electric current selectively to each of the coils to impart a magnetic field to the cores;

a slide assembly located in the path of light from the fiber optic light guide, the slide assembly comprising a housing having windows aligned in said path for the passage of light therethrough, and a slide linearly laterally slidable within said housing between a first position in which it occludes the passage of light along said path between the windows and a second position in which it allows said passage of light, the slide including a permanent magnet, magnetic poles of which are oriented such that the slide is attracted or repelled to move in one direction or an opposite direction according to which of the cores is magnetized;

whereby, when said slide is in said one position light is occluded from passing through the windows and no light shows to the viewer and when said slide is in its second position light passes through the windows to be seen by the viewer; and a computer programmed to variably select ones of the shutters allowing passage of light.

5. A variable display as claimed in claim 4 in which the unit is sealed from the environment.

6. A variable display as claimed in claim 4 including a color filter interposed in the path of light from said fiber optic light guide.

* * * * *